United States Patent [19]

Freeman

[11] Patent Number: 4,838,040

[45] Date of Patent: Jun. 13, 1989

[54] AIR CONDITIONER DRYER UTILIZING WATER-ENCAPSULATING POLYMERS

[76] Inventor: Clarence S. Freeman, P.O. Box 1079, Channelview, Tex. 77530

[21] Appl. No.: 175,345

[22] Filed: Mar. 30, 1988

[51] Int. Cl.[4] ..... F25B 43/04

[52] U.S. Cl. ..... 62/475; 210/689; 210/DIG. 6

[58] Field of Search ..... 62/475, 474; 210/689, 210/DIG. 6, DIG. 7

[56] References Cited

U.S. PATENT DOCUMENTS

| | | | |
|---|---|---|---|
| 2,934,209 | 4/1960 | Frank | 210/DIG. 6 |
| 3,572,050 | 3/1971 | Bottum | 62/474 |
| 3,810,366 | 5/1974 | Orth | 62/474 |
| 4,124,116 | 11/1978 | McCabe, Jr. | 210/DIG. 6 |
| 4,331,001 | 5/1982 | Jones | 62/503 |
| 4,464,261 | 8/1984 | Cullen et al. | 210/DIG. 6 |
| 4,474,661 | 10/1984 | Nearpass et al. | 210/437 |
| 4,509,340 | 4/1985 | Mullally et al. | 62/503 |
| 4,581,903 | 4/1986 | Kerry | 62/474 |
| 4,594,860 | 6/1986 | Coellner et al. | 62/271 |
| 4,633,679 | 1/1987 | Wintersteen | 62/474 |
| 4,637,881 | 1/1987 | Scuito | 210/689 |
| 4,655,801 | 4/1987 | Kojima et al. | 55/218 |
| 4,675,971 | 6/1987 | Masserang | 62/503 |
| 4,745,772 | 5/1988 | Ferris | 62/474 |
| 4,747,960 | 5/1988 | Freeman et al. | 210/689 |

*Primary Examiner*—Ronald C. Capossela
*Attorney, Agent, or Firm*—Vaden, Eickenroht, Thompson & Boulware

[57] ABSTRACT

Containment means in the form of water-absorbing polymers are included in the path of a refrigeration cycle to remove accumulated water or water vapor that inherently develops. Such polymers do not lose their efficiency even when they become oil coated, which occurs because lubricating oil is normally circulated with the refrigerant and refrigerants like freon are also somewhat oily. Preferably such containment means are in the form of polymer granules included in a bag or sack placed in a readily-openable canister, which itself is placed inside the housing of a dehydrator. This dehydrator housing also has a readily opened lid held on by a quick-disconnecting clamping means.

9 Claims, 1 Drawing Sheet

AIR CONDITIONER DRYER UTILIZING WATER-ENCAPSULATING POLYMERS

BACKGROUND OF THE INVENTION

1. Field of the Invention

This invention pertains to refrigeration system dehydrators and more specifically in one aspect thereof to a dehydrator employing water-absorbing polymers.

2. Description of the Prior Art

Refrigeration systems in buildings, residences, automobiles and the like generally employ a number of components that cycle a refrigerant through a closed loop of vapor and liquid phases. Typically, freon, as an example of a suitable refrigerant, changes from a gas condition to a liquid condition and back to a vapor condition as it progresses through a refrigeration cycle. Although the refrigerant is primarily freon, it is well-known that it is advantageous for the refrigerant also to include some lubricating oil to maintain the smooth running operation of the mechanical components and so as to minimize the onset of rust. Further, as the refrigerant cycles through its phases there is an inherent accumulation of water condensate or water vapor. The presence of a minute quantity of water is not particular disadvantageous, but when there is water build up, the efficiency of the refrigeration condition is adversely affected and the presence of water can even cause rust or other damage to the operating components. It is known, for example, that water in the presence of most refrigerants forms an acid that deteriorates the coils and other components of a refrigeration system.

In order to prevent the build up of water in a refrigeration system, a dehydrator is included, normally located in the loop of a simple refrigeration system between the evaporator and the compressor. A typical dehydrator includes a housing in which gas expanded refrigerant is directed as a vapor. Inside the housing is a dessicant that absorbs and thereby drys or removes the water, or at least excess water, from the vapor. In addition to removing water, the usual dehydrator also includes one or more filters for removing solids particulates that might inadvertently be introduced.

Dessicants currently in use when first put into service have proven to be satisfactory. That is, when drying is occurring when the dessicant is fresh, refrigeration of the entire system operates at a high level of efficiency and the parts operate without undue wear. However, the lubricating oil will, in time, begin to coat the dessicant, causing water removal to become less and less efficient until such time as the dehydrator must be replaced.

Dehydrator replacement is not difficult, but it is somewhat expensive. Typically, the system is shut down, the input and output connections to the housing of the dehydrator are disconnected and the dehydrator is replaced. Usually, there is nothing wrong or wornout about the housing of the replaced dehydrator, only the dessicant has been oil-contaminated or has reached its level of water absorption. Nevertheless, the entire unit is replaced.

Therefore, it is a feature of the present invention to provide an improved substance for absorbing water from the coolant or refrigerant of a refrigeration system that remains efficient even when coated with oil.

It is another feature of the present invention to provide an improved dehydrator for a refrigeration system having a replaceable container of water-absorbing or water-encapsulating polymers that provide both efficient operation and is easy and inexpensive to replace.

SUMMARY OF THE INVENTION

The dehydrator used in a preferred embodiment of the present invention is designed for connection between the evaporator and compressor of the refrigeration cycle and, therefore, operational when the refrigerant is mostly in a vapor phase. The substance or containment means located in the dehydrator that removes the water is a water-absorbent or water-encapsulating polymer, typically in granular form and included in a porous bag or sack. A preferred embodiment of the dehydrator includes a housing with a quick-disconnect lid that provides quick access to the inside of housing. A canister in the housing is attached to the output connection therein and also has a lid to provide easy access thereto. A bag or sack of the polymers just described are included in the canister. One or more bottom openings of the canister permits refrigerant vapor to pass over and through the polymer bag for water removal. A reservoir underneath the canister provides for accumulation of liquids that are not vaporized and a suction tube therefrom is connected to the output connection of the dehydrator housing so that as the vapor passes from the canister, it draws the liquid out of the housing reservoir by venturi action. A solids particle filter is included in the output connection of the canister for filtering the vapor and another solids particle filter is included in the suction tube for filtering the liquid drawn from the reservoir.

In operation, the water-absorbing polymers not only remove the water from the refrigerant and prevent its further circulation when first placed into service, they also efficiently continue removing water even after they become coated with oil. Oil is intentionally cycled in the refrigerant to provide lubrication of components and, in addition, liquid freon and other refrigerants are also oily.

When the polymers do become water filled and need to be replaced, the dehydrator housing and canister are both opened and the bag of polymers is easily replaced.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary preferred embodiment thereof which is illustrated in the drawings, which drawings form a part of this specification. It is to be noted, however, that the appended drawings illustrate only a preferred embodiment of the invention and are not to be considered limiting of its scope as the invention may admit to other equally effective embodiments.

In the drawings.

DESCRIPTION OF THE PREFERRED EMBODIMENT

Figure 1:
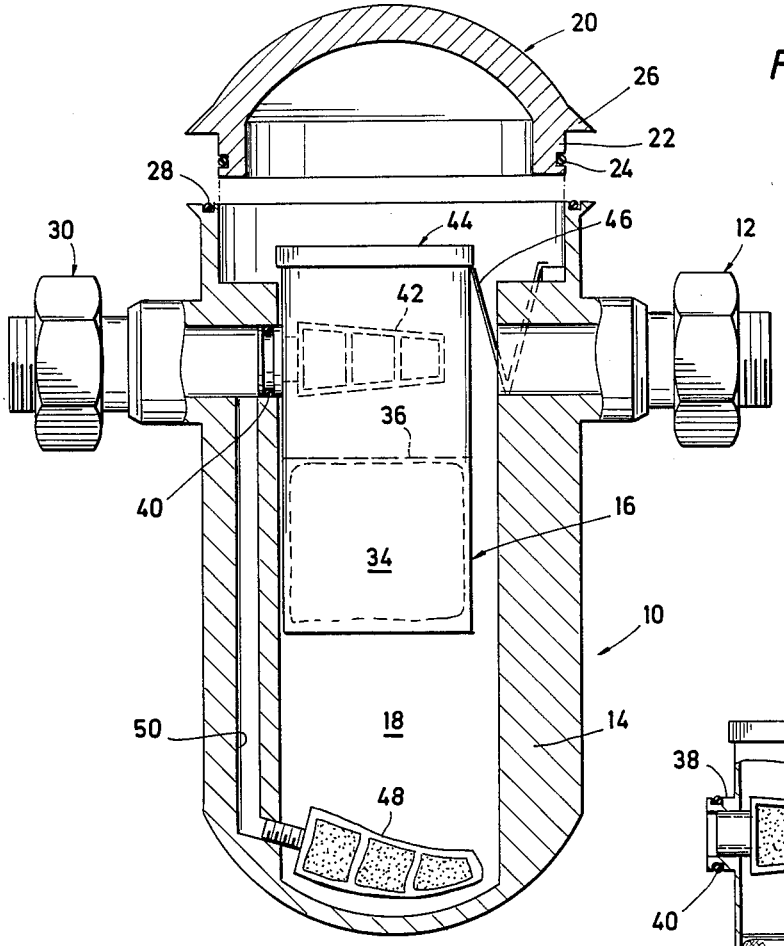
FIG. 1 is a side view of a preferred embodiment of a dehydrator in accordance with the present invention.

Now referring to the drawings and first to FIG. 1, a side view of a dehydrator 10 is illustrated with many of its internal components being shown in dotted lines. Freon or other refrigerant is introduced at input connection 12. This connection generally connects to the line leading from the evaporator of a refrigeration system. The connection is generally secured by a hexagonal nut and by a washer not shown in the illustration.

The refrigerant includes not only the pure coolant material, such as freon, but also includes some lubricating oil for purposes of reducing wear on the operating components of the system. In addition, the refrigerant often carries with it small solid particulates and water vapor. Both the solids and the water are inadvertent and reduce the efficiency of the operating system and increase the wear of the components.

Housing 14 of the dehydrator is large enough to accommodate a canister 16 and to provide for a liquid accumulating reservoir 18 thereunder. The dehydrator is closed by a lid 20 that is provided by an internally depending sleeve segment 22 that is provided with an annular O-ring 24. An overhang 26 of lid 20 seals against the top surface of housing 14, which also includes an annular O-ring, 28. Thus, the two O-rings completely seal against vapor leakage. The lid is secured in place by a quick-disconnect clamping band.

Output or discharge connection 30 of housing 14 is provided so that the output from the dehydrator is connectable to a compressor, in conventional fashion. As with the input connection, the output connection is made tight with a hexagonal nut and washer. The schematic of a closed loop refrigeration system in conjunction with a dehydrator is shown in U.S. Pat. No. 4,331,001, issued May 25, 1982 in the name of Joe W. Jones, which patent is incorporated by reference for all purposes.

Housing 14 is preferably injection molded from fiber-filled plastic. The connection fittings are placed into the mold prior to mold closing and the injection of plastic to thereby provide proper sealing around the connections.

Figure 2:
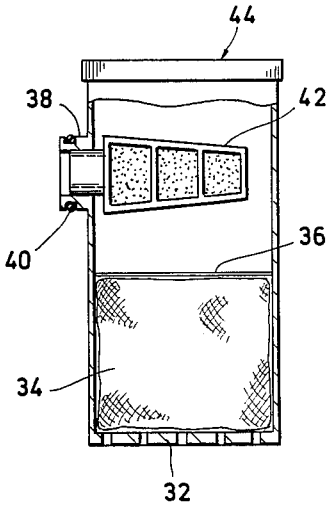
FIG. 2 is a vertical cross-sectional view of the canister included in the embodiment of FIG. 1.
Figure 3:
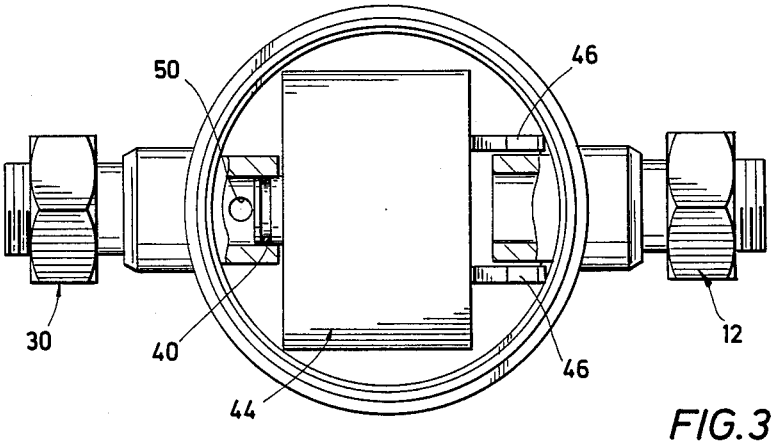
FIG. 3 is a top cross-sectional view of the dehydrator shown in FIG. 1.

Canister 16 is also molded plastic, the bottom thereof being gridded to provide a plurality of openings 32, as best shown in FIG. 2. The grid bottom of the canister provides support for a bag 34 of water-absorbing polymers described more fully below, while permitting refrigerant vapor to flow upward through the openings and the bag. A retention notch is provided internal to the canister wall at a level just above the bag to accommodate a hold-down or tension clip 36. Bag 34 is preferably made of polyester or other convenient fabric and is porous enough to allow the free flow of vapor while keeping the polymers in place. Thus, bag 34 does not become displaced with the upward flow of refrigerant. Alternatively, the compartment within the canister can be closed off top and bottom with non-cloth layers that are perforated to permit the flow or passage of vapors including water vapors, but which holes are small enough so that loose polymers are contained within the canister compartment.

Canister 16 includes near its upper end a molded discharge neck 38, which is notched around its periphery to receive O-ring 40, thereby effecting a seal when the discharge neck is pressed into output connection 30 of housing 14.

A discharge filter 42 includes an elongated output projection for press fitting into the inside of the discharge neck of the canister. Filter 42 is provided to remove the airborne solid particles existing in the refrigerant vapor. The canister is closed by a press fitting and easily opened lid 44. Finally, with respect to the canister, it is urged and held in place toward the output connection of the housing by pressure spring clips 46.

The area around canister 16 at its upper end receives the input flow of refrigerant from input connection 12. The side of canister 10 acts as a diffuser for the incoming flow of refrigerant, which flows mostly down from the input connection where the most room is. The gaseous or vapor portion then progresses up through bottom openings 32 of the canister. However, not all of the refrigerant stays in a gaseous phase. The liquid portion thereof settles into reservoir 18 at the bottom of the housing. Located within this reservoir is a pickup tube filter 48 for filtering the solids from the liquid. Output or pickup tube 50 is connected between filter 48 and output connection 30 at a point just on the discharge side of where discharge neck 38 of canister 16 is connected. Thus, as the gas or vapor flows from the canister, the liquid in the reservoir is sucked by venturi action up through tube 50 to be discharged through the output connection.

The polymers included in bag 34 are water-absorbing or water-encapsulating polymers of granular form. They have the ability of not only absorbing or entrapping water from the refrigerant vapor as it passes therethrough, the polymers also do not lose this ability as they become oil coated by the freon and by the lubricating oil that is airborne by the vaporized refrigerant. In addition, such polymers have the ability of absorbing and removing many times the amount of water removed by present dessicants in use.

Preferred polymers that are suitable for the containment means or having the water-absorbing or water-encapsulating qualities referred to above are the super water absorbent polymer salts and/or mixed salts, e.g., salts of carboxylate described more fully in U.S. Pat. No. 4,752,997,issued June 28, 1988, Clarence S Freeman et al., which patent is adopted by reference herein for all purposes. More specifically, super absorbent carboxylate polymer salts and/or mixed salts include the alkali ions: lithium, $Li^+$, sodium, $Na^+$, potassium, $K^+$; or the alkaline earth metal ions: magnesium, $Mg^+$; calcium, $Ca^+$; strontium, $Sr^{++}$; Barium, $Ba^+$; zinc, $Zn^+$; aluminum, $Al^{++}$ of cross-linked carboxylate polymers and/or copolymers. Suitable polymer salts and/or mixed salts that exhibit suitable water-encapsulating properties can also be selected from a group consisting of a polymer having attached sulfate groups, a polymer having attached phosphate groups, and a polymer having attached sulfonate groups. As noted, two important characteristics of such polymers is that they absorb water without entering into any heating-producing chemical reaction and they do not give up the encapsulated or entrapped water once the water has been captured.

The preferred granular size for the polymers is 50 to 150 mesh, although the granular size is not particularly critical for the purposes herein described.

It may be now seen that when the polymers need to be replaced, lids 20 of the dehydrator housing and 44 are removed, hold down spring 36 is disconnected and bag 34 is replaced. Then, the spring is put back in place and the lids are reset. All of this can be easily and quickly done, usually in only a minute or so, without disconnecting either of connections 12 and 30 to the dehydrator or replacing major hardware components of the dehydrator. The solids particle filters 42 and 48 are independently replaceable, when necessary.

While a preferred embodiment of the invention has been described and illustrated, it will be understood that he invention is not limited thereto, since many modifications may be made and will become apparent to those skilled in the art. For example, although the containment means has preferably been described in terms of water-encapsulating polymer granules included in a porous bag, the containment means could alternately be in vapor-permeable paper form, if desired. Also, cloth of various material blends or molded plastic forms could be employed, if desired. Moreover, it should be evident that the housing and canister construction that permits easy entry can be used with dessicants conventionally in use and not just with water-absorbing polymers.

What is claimed is:

1. In combination with an air conditioner system utilizing refrigerant including lubricating oil and accumulating water vapor, at least the majority of the circulating refrigerant cycling from a vapor phase to a liquid phase to a vapor phase, the improvement of containment means comprising, water-encapsulating polymers for absorbing and thereby removing accumulating water from the refrigerant, said polymers continuing to efficiently absorb water after becoming coated with said oil.

2. A dehydrator for removing water from the refrigerant of a refrigeration system, said refrigerant including lubricating oil and accumulating water vapor, said dehydrator being suitable for location between the evaporator and the compressor, comprising a housing having an input connection for connecting to the evaporator and an output connection for connecting to the compressor, said housing including a quick-disconnect opening means for exposing the inside of said housing without disconnecting said housing from either the evaporator of the compressor, and a canister secured internally within said housing and connected to said output connection thereof, said canister being readily openable to accommodate water-encapsulating polymers therein and having at least one opening to permit refrigerant vapor to pass into said canister, said water-encapsulating polymers encapsulating water from the refrigerant.

3. A dehydrator in accordance with claim 2, wherein said water-encapsulating polymers continue to efficiently encapsulate water after becoming coated with oil.

4. A dehydrator in accordance with claim 3, and including a replaceable porous bag for enclosing said polymers.

5. A dehydrator in accordance with claim 4, wherein said bag is made of polyester cloth.

6. A dehydrator in accordance with claim 2, wherein said canister is sized to provide a reservoir within the housing beneath the canister where the non-vaporized refrigerant settles after entry into said housing, and including a pick-up tube connected between said reservoir and said output connection, the exiting refrigerant vapor through said output connection causing emptying of said reservoir by venturi action.

7. A dehydrator in accordance with claim 6, and including a first solids particle filter connected within said canister to said output connection and a second solids particle filter connected to said pickup tube.

8. A dehydrator in accordance with claim 2, wherein said quick-disconnect means includes a removable lid to said housing and a releasable clamping band for holding said lid on said housing.

9. The improvement of containment means in accordance with claim 1, wherein said water-encapsulating polymers include a polymer selected from the group consisting of a polymer having attached carboxylate groups, a polymer having attached sulfate groups, a polymer having attached phosphate groups, and a polymer having attached sulfonate groups.

* * * * *